United States Patent [19]

Morrison et al.

[11] 4,207,087

[45] Jun. 10, 1980

[54] MICROCOMPUTER CONTROLLED GAME

[75] Inventors: Howard J. Morrison, Deerfield, Ill.; Ralph H. Baer, Manchester, N.H.

[73] Assignee: Marvin Glass & Associates

[21] Appl. No.: 834,643

[22] Filed: Sep. 19, 1977

[51] Int. Cl.[3] ..... A63B 71/04

[52] U.S. Cl. ..... 273/1 E

[58] Field of Search ..... 35/6, 22 R, 48 R; 235/92 GA; 180/99; 273/1 E, 85 G, 138 A, 237, DIG. 28; 340/384 R, 384 E, 279; 364/200, 410, 411, 900

[56] References Cited

U.S. PATENT DOCUMENTS

| | | | |
|---|---|---|---|
| 3,371,321 | 2/1968 | Adams | 35/8 R |
| 3,654,710 | 4/1972 | Barnard | 273/1 E X |
| 3,831,172 | 8/1974 | Olliges et al. | 273/85 G |
| 3,869,812 | 3/1975 | Arakelian et al. | 35/22 R |
| 3,922,665 | 11/1975 | Curry et al. | 340/279 |
| 3,942,151 | 3/1976 | Takeuchi | 180/99 X |
| 4,000,489 | 12/1976 | Bench | 273/1 E X |
| 4,019,745 | 4/1977 | Mustelier | 273/237 |
| 4,044,475 | 8/1970 | Fujisawa et al. | 35/6 |
| 4,051,605 | 10/1977 | Toal et al. | 35/48 R |

OTHER PUBLICATIONS

*Popular Electronics*, "Logidex An Electronic Game for all Seasons," Nov. 1973, pp. 63–66.

*Electronics*, "Games;" Jun. 24, 1976, pp. 89–96.

*"Touch-Me," Operating and Maintenance Manual*, 1974, pp. 1–8.

*Primary Examiner*—Vance Y. Hum

*Attorney, Agent, or Firm*—Mason, Kolehmainen, Rathburn & Wyss

[57] ABSTRACT

A game utilizes a microprocessor for controlling the play of one or more games in which a participant may play against the machine or against another participant. When played against the machine, the machine generates a random sequence of tones which must be accurately repeated by the participant. The machine then repeats the latest sequence and adds another tone to the sequence. The process is repeated until the participant makes an error, or until the sequence reaches a predetermined length. When played between two or more participants, each participant increases the length of the sequence until one of the participants makes an error whereupon the machine "eliminates" the player. The machine keeps track of the longest correct sequence and indicates which participant is in error.

39 Claims, 6 Drawing Figures

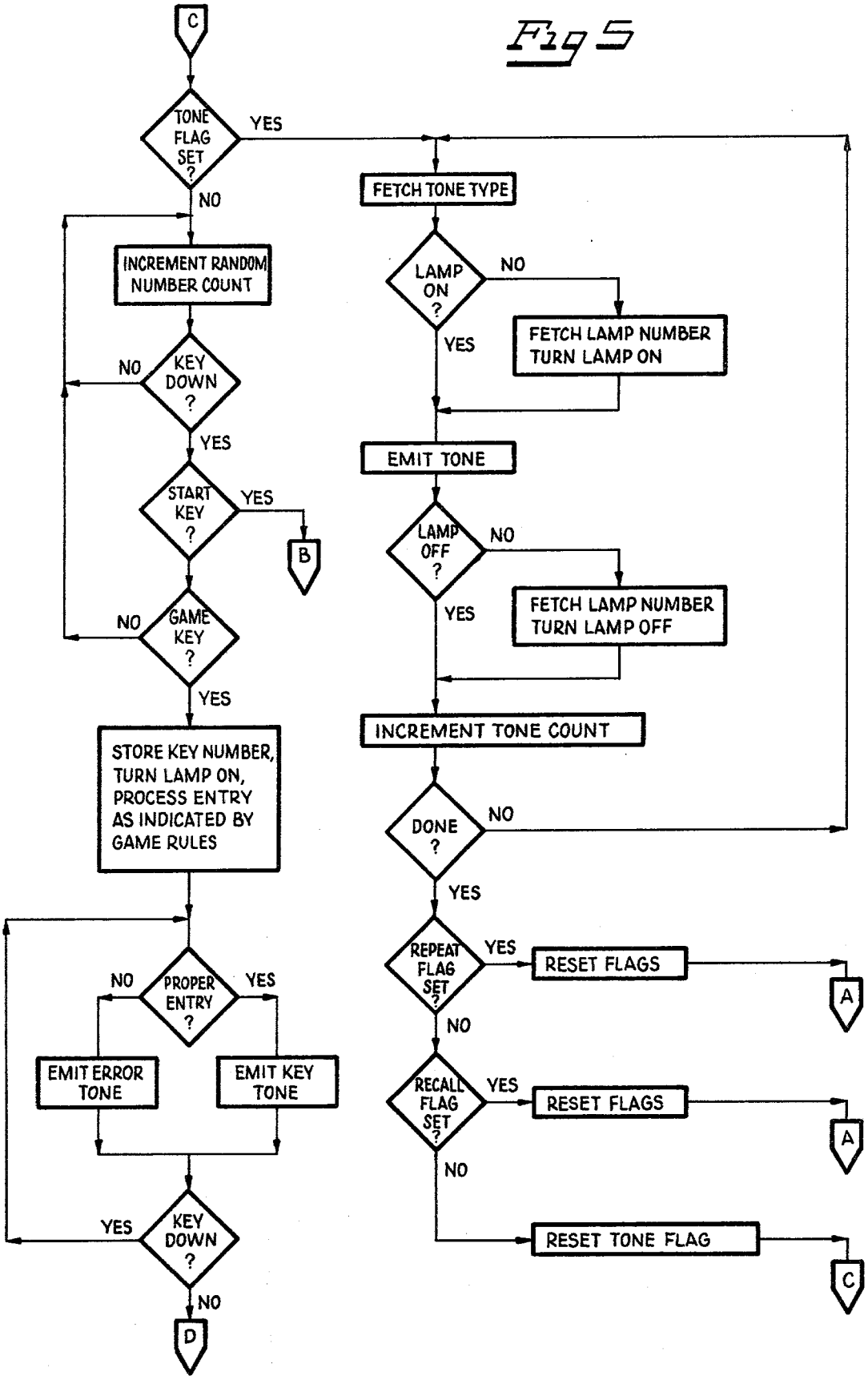
Fig 5
C
TONE FLAG SET ?
YES
NO
INCREMENT RANDOM NUMBER COUNT
KEY DOWN ?
NO
YES
START KEY ?
YES
B
GAME KEY ?
NO
YES
STORE KEY NUMBER, TURN LAMP ON, PROCESS ENTRY AS INDICATED BY GAME RULES
PROPER ENTRY ?
NO
YES
EMIT ERROR TONE
EMIT KEY TONE
KEY DOWN ?
YES
NO
D
FETCH TONE TYPE
LAMP ON ?
NO
YES
FETCH LAMP NUMBER TURN LAMP ON
EMIT TONE
LAMP OFF ?
NO
YES
FETCH LAMP NUMBER TURN LAMP OFF
INCREMENT TONE COUNT
DONE ?
NO
YES
REPEAT FLAG SET ?
YES
RESET FLAGS
A
NO
RECALL FLAG SET ?
YES
RESET FLAGS
A
NO
RESET TONE FLAG
C

MICROCOMPUTER CONTROLLED GAME

BACKGROUND OF THE INVENTION

1. Field of the Invention

This invention relates generally to games and, more particularly, to an electronic board game that provides audible and visual indications of the progress of the game to the game participant.

2. Description of the Prior Art

Electronic tone producing and musical games and toys are known. Such games and toys usually take the form of low cost musical instruments, such as pianos, organs and the like, or musical devices that automatically sequence through a plurality of tones or special effects. Electronically generated musical tones have also been utilized in conjunction with pinball type machines to indicate the progress of the game, and machines that generate a random sequence of numbers which must be guessed by a participant have been devised. However, while these machines do provide a great deal of amusement, such machines generally do not provide a game wherein a participant may play against the machine or with a device that controls the interaction of two participants.

SUMMARY OF THE INVENTION

Accordingly, it is an object of the present invention to provide an electronic game that controls the interaction between two participants, or which can be played against the machine itself.

It is another object of the present invention to provide a game that tests the aural and visual memory of a participant against the machine.

It is a further object of the invention to provide a keyboard type game device that provides an automatic sequence of events that must be repeated by a participant.

It is yet another object of the invention to provide a microprocessor controlled game that controls the progress of a game played between two participants.

It is yet another object of the present invention to provide a microprocessor controlled game that can be programmed to play a variety of games.

In accordance with a preferred embodiment of the invention, there is provided a device having a keyboard controlling a plurality of push-button switches, each associated with a tone or light, or both. The device utilizes a microprocessor to generate a sequence of tones, each associated with a light and one of the keyswitches on the keyboard. The microprocessor is programmed to generate a random sequence of tones or lights, or both, which must be repeated by a participant by depressing the proper keyswitches. If the participant correctly repeats the sequence, the machine adds another entry to the sequence and plays the lengthened sequence which must again be repeated by the participant. The process is repeated to provide an ever-lengthening sequence until the participant makes an error or, if desired, until the sequence reaches a predetermined length. The machine then indicates whether the machine or the participant has won, and may be programmed to indicate the longest sequence successfully repeated. Also, the tone generation or the light generation may be suppressed to provide a game playable in response to tone or light sequences only. Also, controls may be provided for increasing the speed of the game either manually or automatically as the game progresses.

In an alternative embodiment, the machine can be used to control the interaction of two participants. In such an embodiment, one of the participants generates a first sequence that must be repeated by the other, who adds a subsequent event to the sequence. As in the case of the above-described embodiment, the machine keeps track of the longest sequence successfully repeated and declares a winner when one of the participants makes an error. Also, as in the case of the above embodiment, the sequence may take the form of a tone sequence, light sequence or combination of a tone and light sequence.

DESCRIPTION OF THE DRAWING

These and other objects and advantages of the present invention will become more apparent by reference to the following description taken in conjunction with the accompanying drawings, wherein:

FIGS. 4–6 are logical flow charts illustrating the functions performed by the microprocessor controlling the operation of the game according to the invention.

DETAILED DESCRIPTION OF THE PREFERRED EMBODIMENT

Figure 1:
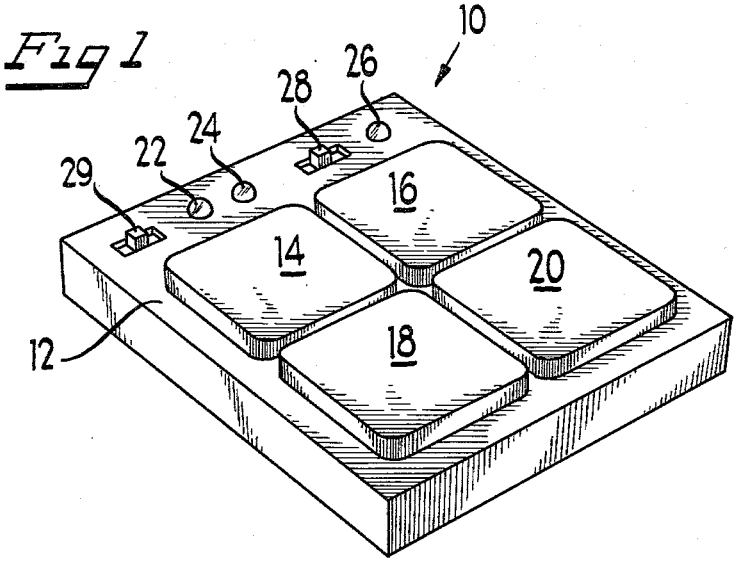
FIG. 1 is a perspective view of a preferred embodiment of the device according to the invention.

Referring now to the drawing, with particular attention to FIG. 1, there is shown an embodiment of the game according to the present invention generally designated by the reference numeral 10. The game 10 includes a housing 12 that contains four push-button keyswitches 14, 16, 18 and 20 that are operated by a participant playing the game. Each of the push-button keyswitches 14, 16, 18 and 20 is associated with a particular tone that is sounded when a respective one of the keyswitches is depressed. In addition, one of a plurality of indicator lights may be illuminated upon depression of each of the keyswitches. In the embodiment illustrated in FIG. 1, the indicator lights are located under the respective keyswitches and serve to illuminate the keyswitches as they are depressed. In addition, control push-button switches 22, 24 and 26 are provided which permit the recall of the last played tone sequence, the longest tone sequence and control the start of a new game, respectively. A slide switch 28 permits the user to select one of several games playable by the unit, and a switch 29 selects the length of the sequence that must be achieved for the participant to be declared a winner.

Several games may be played by the device 10 illustrated in FIG. 1. Such games are selected by appropriately positioning the slide switch 28. Five games are described below; however, the microprocessor (described in a subsequent portion of the specification) may be programmed to play other games.

GAME 1

Upon depression of the start of game switch 26, the microprocessor will cause one of four notes contained in its memory to be sounded. In addition, one of the four indicator lights associated with a particular one of the keyswitches 14, 16, 18 and 20 will be illuminated. The participating player must now depress the one of the keyswitches 14, 16, 18 and 20 associated with the tone sounded, as indicated by the illumination of its associated lamp. If the participant depresses the correct one of the four keyswitches 14, 16, 18 and 20, the machine repeats the previous tone and adds a new tone (and associated light) to the sequence. The game continuous with the participant and the device 10 each repeating the entire prior sequence, and with the machine always adding one more tone to the prior sequence. At the first occurrence of an erroneous key entry, the microprocessor causes a distinctive error signal to be sounded. This concludes the game sequence. Also, the microprocessor may be programmed to generate a second distinctive "win" signal when the sequence reaches a predetermined length. For example, the length of such a sequence may be selected to be eight, fourteen or twenty tones by appropriately positioning the switch 29. Finally, the device 10 may be programmed to increase the speed of the sequence as the game is played to make the game more challenging.

After the conclusion of the game sequence, the participant has the option of starting a new game by depressing the push-button switch 26, or he can review the previously keyed-in tone sequence by pushing the last game review pushbutton 22. Upon such a command, the microprocessor will automatically sound out the entire sequence of tones that had been keyed in up to the point at which the keying error was made. The longest sequence played to date can be reviewed by depressing the push-button switch 24.

GAME 2

Game 2 is selected by appropriately positioning the selector switch 28. In this game, two participants take turns alternately repeating the previous sequence and adding another tone to the sequence. The device 10 is programmed to keep track of the last sequence, and to sound the error signal whenever one of the participants makes an error. As in the case of Game 1, the longest tone sequence played by the participants during any continuous series of games may be stored, and the push-button switch 24 used to recall this sequence. In this manner, it is possible for the winner of a game to compare his performance with the longest tone sequence in the memory.

GAME 3

This game is essentially a modification of either Game 1 or Game 2 wherein the participant must respond within a predetermined time interval, for example, before the tone ends, or before its associated light extinguishes. If the player reacts too slowly, or makes an error, the game ends.

GAME 4

In this game, the device is programmed to remember not only the sequence of keyswitch entries, but also to remember the length of time that each keyswitch is depressed and the time interval between such depressions. Thus, the device can be programmed to play tunes that are within the four tone capability (in the present embodiment) of the device. If these four tones are properly selected to correspond to the tones formed in a bugle, then most familiar bugle calls could be keyed in the machine.

GAME 5

This game is designed to be played by more than one player. For example, two players may each be assigned two keys, or four players may each be assigned a single key. The game may be played in a manner similar to that of Game 1, with the machine generating an ever-lengthening sequence of tones which must be repeated by the players, with each player being responsible for repeating his assigned tone or tones as they occur in the sequence. Whenever a player responsible for a tone responds incorrectly by depressing the wrong key, or by not responding, that tone is taken out of the sequence and play continues among the remaining players. Also, the push button assigned to the participant making the error is caused to blink to indicate which player has made the error. The machine then continues building ever-lengthening sequences based on the remaining tones. When another error occurs, the player responsible for that tone is out, and the game continues with sequences containing only the remaining tones until only one player is left.

The above games have been given by way of example only, and the number of possible games is limited only by the capability of the microprocessor within the device and the ingenuity of the programmer. The number of games that may be played is considerably greater than the five examples given.

Figure 2:
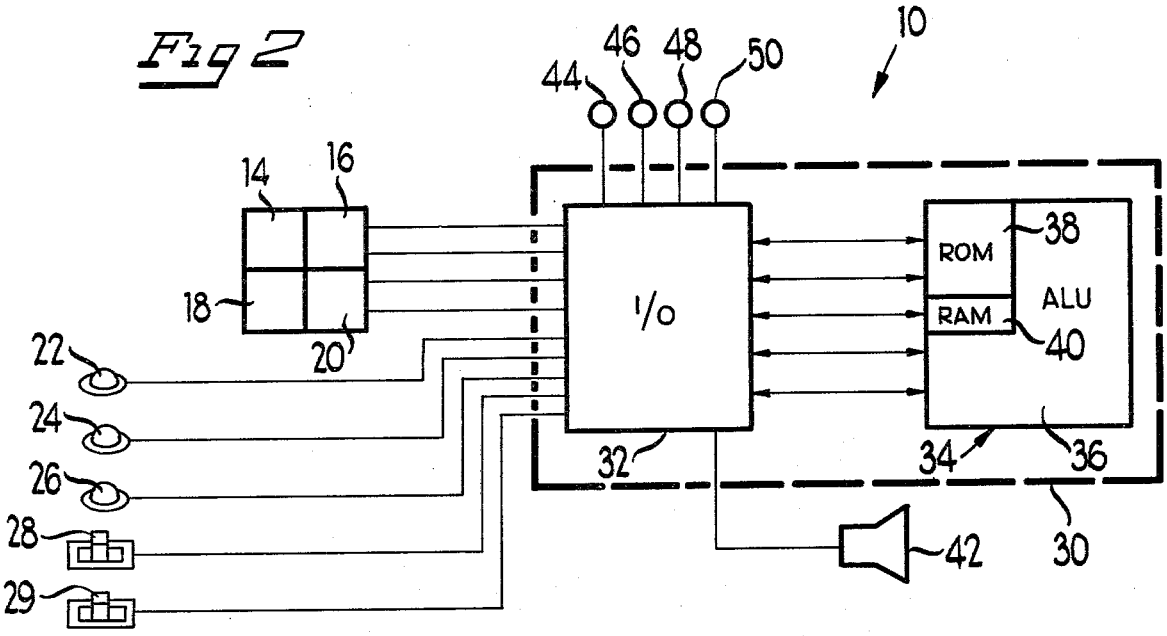
FIG. 2 is a block diagram of the electrical components of the game according to the invention.

Referring now to FIG. 2, the device 10 utilizes a microprocessor 30 having an input/output section 32 connecting the manually operable switches 14, 16, 18, 20, 22, 24, 26, 28 and 29 to a computing device 34 having an arithmetic logic unit 36, a read-only memory 38, and a random-access memory 40. The arithmetic logic unit processes the inputs received from the various input devices in accordance with the game selected from the read-only memory 38 by the selector switch 28 and serves to operate a loud speaker 42 and four light indicators 44, 46, 48 and 50, each associated with a respective one of the keyswitches 14, 16, 18 and 20 in accordance with the rules of the game selected. Thus, when one of the games stored in the read-only memory 38 is selected by the switch 28, the arithmetic logic unit 36 operates on the inputs from the keyswitches 14, 16, 18 and 20 to perform the necessary arithmetic logic steps and to store the necessary data, such as the length of the last sequence into the random-access memory 40. The arithmetic logic unit 36 also serves to provide the necessary responses to the participant by appropriately lighting up the lights 44, 46, 48 and 50, and sounding the appropriate tone or error signal through the loud speaker 42.

Figure 3:
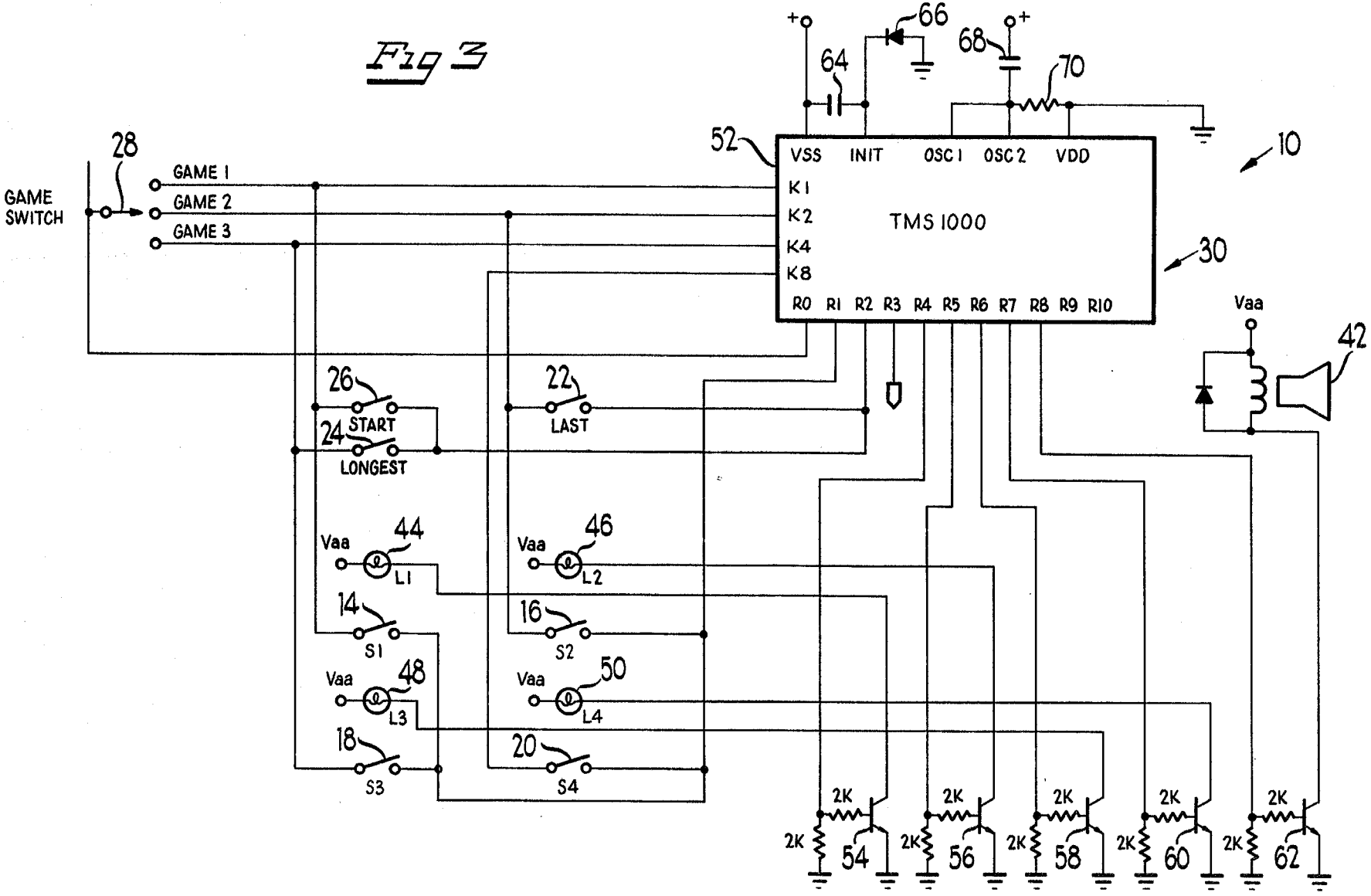
FIG. 3 is a detailed schematic diagram of the electronic circuitry of the game according to the present invention.

Referring to FIG. 3, the device 10 illustrated in FIG. 2 can readily be implemented utilizing a single chip, large scale integrated circuit microprocessor 52 as the main computing device. A TMS1000 single chip microprocessor manufactured by Texas Instruments, Inc. is suitable for use as the microprocessor 52, and contains the input/output circuitry 32 and the computing device 34 illustrated in FIG. 2. Driver transistors 54, 56, 58, 60 and 62, serving as part of the input/output circuitry 32, are driven by outputs of the microprocessor 52, and serve to drive the lights 44, 46, 48 and 50 and the loud speaker 42. A time delay circuit comprising a capacitor 64 and a diode 66 serve to reset and initiate the operation of the microprocessor each time the power is turned on. A timing circuit comprising a capacitor 68 and a resistor 70 controls the operation of the internal clock of the microprocessor 52.

The microprocessor 52 monitors the state of the play keyswitches 14, 16, 18 and 20, the control switches 22, 24 and 26 and the game selector switch 28 by sequentially energizing its outputs R0-R10 while monitoring its inputs K1, K2, K4 and K8. Thus, when the output R0 is energized, the device can determine the position of the keyswitch 28 by determining which of its inputs K1, K2 or K4 is energized. Similarly, the microprocessor R1 can determine which of the switches 14, 16, 18 and 20 is energized by monitoring the four inputs K1, K2, K4 and K8 during the time that the output R1 is energized. In a similar manner, the device monitors the inputs K1, K2 and K4 during the time that the output R2 is energized to determine which, if any, of the switches 22, 24 and 26 is energized. The outputs R4-R8 are utilized to drive the driving transistors 54, 56, 58, 60 and 62 which, in turn, drive the indicator lights 44, 46, 48 and 50 and the loud speaker 42.

Figure 6:
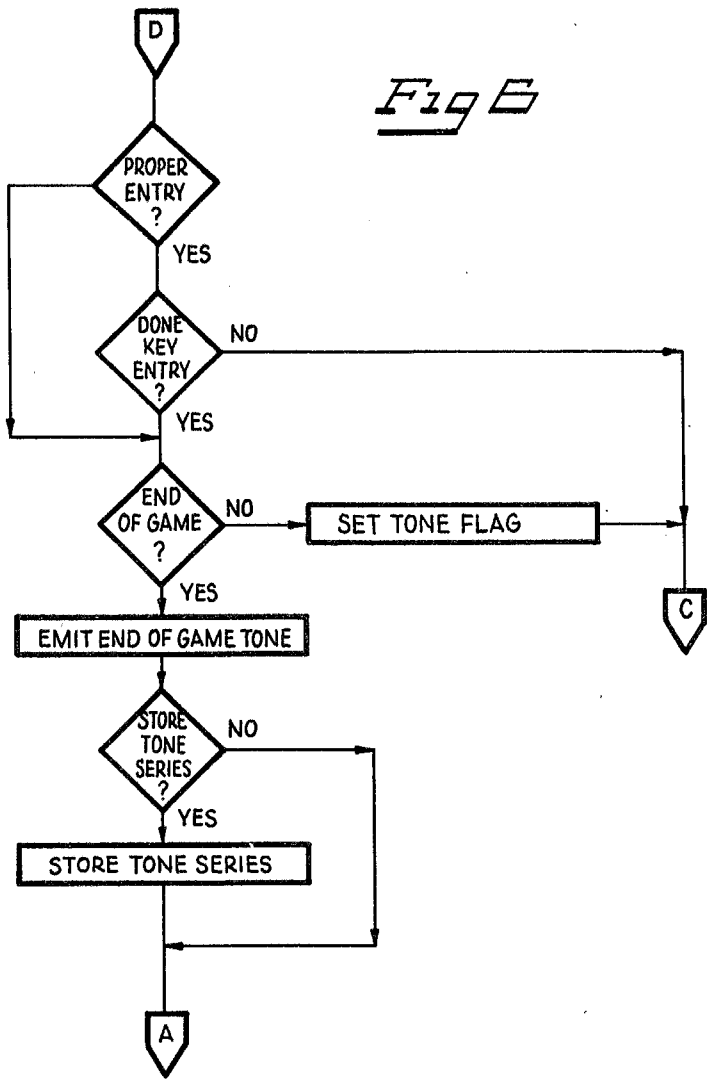

The microprocessor 52 is readily programmed in a manner described in the TMS1000 series data manual published in December 1975 by Texas Instruments, Inc. to perform the functions necessary to play the desired games. Flow charts illustrating the programming of the microprocessor are illustrated in FIGS. 4–6.

Figure 4:
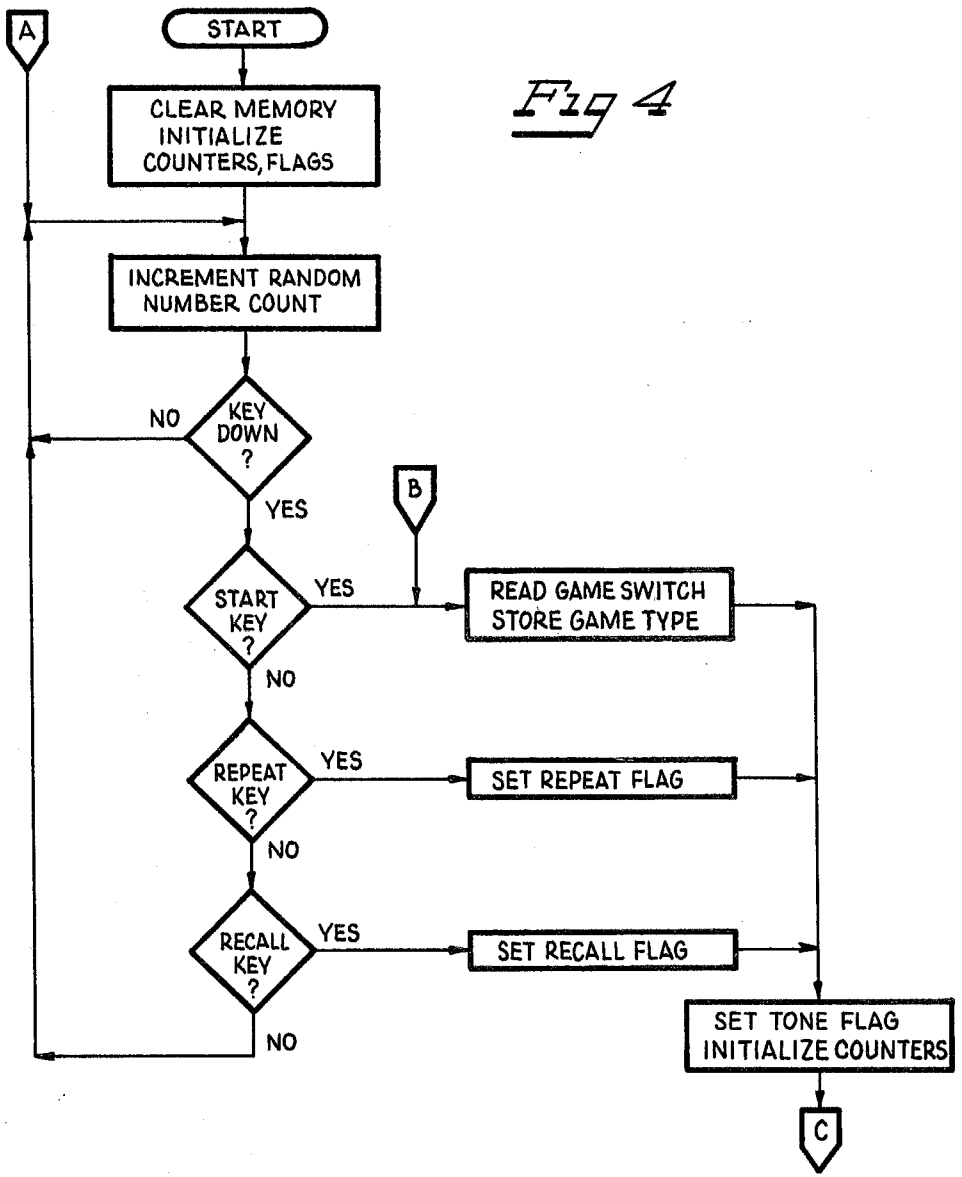

When the start switch 26 is depressed, the memory of the microprocessor 52 is cleared and the random number count is incremented (FIG. 4). A determination is made whether any of the push-button keys are depressed. If not, the random number count is continuously incremented. If one of the keys is depressed, a determination is made to determine which of the keys has been depressed. If the start key has been depressed, the microprocessor 52 reads the position of the game selecting switch 28 and selects the stored game corresponding to that position. If the key requesting the repeat of the last sequence or the key requesting the recall of the longest sequence is depressed, the appropriate repeat or recall flag is set. Also, the tone flag is set and the counters are initialized.

If the start key has been depressed, causing the appropriate game to be stored, the tone to be flag set and the counters to be initialized, the setting of the tone flag causes a particular tone type to be fetched (FIG. 5). A determination is then made whether the lamp associated with that tone type is on. If the lamp is on, the tone is emitted, otherwise the lamp is first turned on and the tone emitted. After the tone has been emitted, the lamp is turned off and the tone count incremented. If the repeat and recall flags are not set, which is normally the case during the time that a game is being played, the tone flag is reset. After the tone flag is reset, another determination is made to determine whether a key is depressed (left branch of FIG. 5). If one of the game keys is depressed, a determination is made to determine whether the proper entry, as dictated by the game rules, has been depressed. Based on this determination, either an error tone or a tone corresponding to the depressed game key is sounded. At the same time, if the entry is not proper, an end of game tone is sounded (FIG. 6) and tone series stored. If the entry is proper and the game is not otherwise terminated, the tone flag is again set and the next tone is sequence generated (FIG. 5) until an error occurs.

Obviously, many modifications and variations of the present invention are possible in light of the above teachings. Thus, it is to be understood that, within the scope of the appended claims, the invention may be practiced otherwise than an specifically described above.

What is claimed and desired to be secured by Letters Patent of the United States is:

1. A sequencing game comprising:

means for generating a sensorially perceptible time sequence of events, said sequence generating means including means for generating a plurality of distinct sensorially perceptible events in a predetermined time sequence and at a predetermined time rate;

means actuable by a participant for responding to said time sequence of events, said participant actuable means including a plurality of manually operable controls, each associated with a single one of said distinct sensorially perceptible events and actuable by the participant in response to one of said distinct events;

means coupled to said time sequence generating means and to said participant actuable means for determining the corrections of the participant's response, said correctness determining means including means for storing a representation of the time sequence generated by said time sequence generating means and means for comparing the stored representation of the time sequences generated by said time sequence generating means with the time sequence of actuation of said manually operable controls, said comparing means including means for providing a first indication when said manually operable controls are actuated in a predetermined sequence corresponding to the sequence generated by said time sequence generating means and for generating a second indication when said manually operable controls are actuated in a time sequence other than said predetermined time sequence;

means responsive to said second indication for generating an error signal and to said first indication for increasing the length of the time sequence generated by said time sequence generating means and for rendering said time sequence generating means operative to generate said increased length time sequence;

means responsive to the length of said time sequence for increasing said predetermined time rate when the length of said sequence exceeds a predetermined length; and means coupled to said representation storing means for providing a repetition of the last generated sequence that was followed by a correct participant response.

2. A sequencing game as recited in claim 1 wherein said sensorially perceptible event generating means includes means for generating a plurality of distinct aurally perceptible tones.

3. A sequencing game as recited in claim 1 wherein said sensorially perceptible event generating means includes means for generating a plurality of distinct visually perceptible light indications.

4. A sequencing game device comprising:

a housing;

a microprocessor disposed within said housing;

a plurality of manually operable means affixed to said housing, each manually operable means being individually operable by a single one of a plurality of players;

means within said microprocessor for generating a sensorially perceptible time sequence of distinct, serially occurring events individually and in a random time sequence, with each distinct event being associated with a single corresponding one of said manually operable means;

means within said microprocessor operatively coupled to said manually operable means and to said sequence generating means for comparing the time sequence of events generated by the sequence generating means with a manually entered time sequence of events generated by individual and sequential operation of said manually operable means, said comparing means being operative to provide an error signal when an event of said manually entered sequence generated by an improper operation of one of said manually operable means does not correspond to a corresponding event of the sequence generated by said sequence generating means, said comparing means including means for deleting from the sequence generated by said sequence generating means the distinct events in that sequence associated with the improperly operated one of said manually operable means, thereby rendering said sequence generating means operative to generate a reduced event sequence of only those distinct events that have not been deleted from the sequence;

means cooperating with said generating means for causing said generating means to add to the reduced event sequence another distinct event chosen from those distinct events that have not been deleted from the sequence; and means for providing a win indication to the player operating the one of said manually operable means associated with the last remaining distinct event in the reduced event sequence when the number of distinct events in the reduced event sequence is reduced to one.

5. A sequencing game as recited in claim 4 further including means for visually indicating the one of said manually operable means that was improperly operated.

6. A sequencing game as recited in claim 4 further including means for audibly indicating that one of said manually operable means was improperly operated.

7. A sequencing game as recited in claim 6 wherein each of said manually operable means includes a push button.

8. A sequencing game device as recited in claim 4 wherein said sensorially perceptible time sequence generating means includes means for generating said sensorially perceptible time sequence of distinct serially occurring events at a predetermined rate and means responsive to the length of said time sequence for increasing said predetermined time rate when the length of said sequence exceeds a predetermined length.

9. A sequencing game device comprising:

a housing;

a microprocessor disposed within said housing;

a plurality of manually operable means, each individually and sequentially operable for entering a corresponding individual distinct event into said game device serially in a time sequence determined by the sequence of manual operation of said manually operated means;

a plurality of light sources affixed to said housing, each of said light sources being associated with a single one of said manually operable means and illuminated upon manual operation of the associated manually operable means;

means within said microprocessor for generating a plurality of distinct tone frequencies, each of said distinct tone frequencies being individually associated with one of said manually operable means and being individually generated upon the manual operation of said associated manually operable means, said tone generating means further including means for generating an error tone;

transducer means coupled to said tone frequency generating means for generating a distinct audible tone in response to each of said distinct tone frequencies and in response to said error tone;

means within said game device responsive to the sequential operation of said manually operable means for storing representations of a first sequence of events and for storing representations of a second subsequently entered longer sequence of events; and means coupled to said first and second sequence storing means for comparing said first and second sequences, said comparing means being operative to provide a first indication if the first portion of the last entered of said first and second sequences corresponds to the entire first entered of said first and second sequences and for providing an error indication if said first portion of the last entered sequence does not correspond to the entire first entered of said first and second sequences.

10. A sequencing game device as recited in claim 9 wherein said manually operable means includes a plurality of push buttons.

11. A sequencing game device as recited in claim 9 further including means for generating a plurality of distinct tones, each tone being associated with a single one of said push buttons and sounded in response to the actuation thereof.

12. A sequencing game device as recited in claim 11 further including a plurality of lights, each light being associated with a single one of said push buttons and responsive to the actuation thereof.

13. A sequencing game device as recited in claim 9 wherein said distinct tone frequency generating means further includes means for generating a win tone when the length of one of said first and second sequences exceeds a predetermined length.

14. A microprocessor controlled electronic board game comprising:

a housing;

a microprocessor mounted within said housing;

a plurality of manually operable push buttons affixed to said housing and operable from outside said housing;

means within said microprocessor for generating a random time sequence of serially occurring events at a predetermined rate;

means for serially generating a plurality of distinct sensorially perceptible occurrences, each associated with one event of said random time sequence of events and with one of said push buttons, each of said distinct occurrences being activated in response to the associated event and in response to the actuation of said associated push button;

control means coupled to said random time sequence generating means for rendering said random time sequence generating means operative to generate a first time sequence of events and subsequently for rendering said occurrence generating means responsive to the serial actuation of said push buttons;

means responsive to said push buttons and said random time sequence generating means for comparing said random time sequence of events with a manually entered time sequence of serial and individual operation of said push buttons, said comparing means being operative to generate an error signal and terminating play the first time an event of said manually entered time sequence is not identical to a corresponding event of said random sequence of events, and for rendering said control means operative to increase the length of said random sequence when said entered sequence corresponds to said random sequence; and means responsive to the length of said random sequence for increasing said predetermined rate when the length of said sequence is increased.

15. A microprocessor controlled electronic board game as recited in claim 14 wherein said sensorially perceptible occurrences include musical tones.

16. A microprocessor controlled electronic board game as recited in claim 14 wherein said sensorially perceptible occurrences include flashing lights.

17. A microprocessor controlled electronic board game as recited in claim 14 wherein said control means includes means for adding an additional event to the end of said random sequence when said entered sequence corresponds to said random sequence.

18. A sequencing game comprising:

means for generating a sensorially perceptible time sequence of events, said sequence generating means including means for generating a plurality of distinct sensorially perceptible events in a predetermined time sequence and at a predetermined time rate;

means actuable by a participant for responding to said time sequence of events, said participant actuable means including a plurality of manually operable controls, each associated with a single one of said distinct sensorially perceptible events and actuable by the participant in response to one of said distinct events;

means coupled to said time sequence generating means and to said participant actuable means for determining the correctness of the participant's response, said correctness determining means including means for storing a representation of the time sequence generated by said time sequence generating means and means for comparing the stored representation of the time sequences generated by said time sequence generating means with the time sequence of actuation of said manually operable controls, said comparing means including means for providing a first indication when said manually operable controls are actuated in a predetermined sequence corresponding to the sequence generated by said time sequence generating means and for generating a second indication when said manually operable controls are actuated in a time sequence other than said predetermined time sequence;

means responsive to said second indication for generating a error signal and to said first indication for increasing the length of the time sequence generated by said time sequence generating means and for rendering said time sequence generating means operative to generate said increased length time sequence;

means responsive to the length of said time sequence for increasing said predetermined time rate when the length of said sequence exceeds a predetermined length; and means coupled to said representation storing means for providing a repetition of the longest generated sequence that was generated by a correct participant response.

19. A sequencing game comprising:

means for generating a sensorially perceptible time sequence of events, said sequence generating means including means for generating a plurality of distinct sensorially perceptible events in a predetermined time sequence and at a predetermined time rate;

means actuable by a participant for responding to said time sequence of events, said participant actuable means including a plurality of manually operable controls, each associated with a single one of said distinct sensorially perceptible events and actuable by the participant in response to one of said distinct events;

means coupled to said time sequence generating means and to said participant actuable means for determining the correctness of the participant's response, said correctness determining means including means for storing a representation of the time sequence generated by said time sequence generating means and means for comparing the stored representation of the time sequences generated by said time sequence generating means with the time sequence of actuation of said manually operable controls, said comparing means including means for providing a first indication when said manually operable controls are actuated in a predetermined sequence corresponding to the sequence generated by said time sequence generating means and for generating a second indication when said manually operable controls are actuated in a time sequence other than said predetermined time sequence;

means responsive to said second indication for generating an error signal and to said first indication for increasing the length of the time sequence generated by said time sequence generating means and for rendering said time sequence generating means operative to generate said increased length time sequence;

means responsive to the length of said time sequence for increasing said predetermined time rate when the length of said sequence exceeds a predetermined length; and means responsive to the length of said sequence for generating a win signal when said sequence reaches a predetermined length.

20. A sequencing game as recited in claim 19 further including means coupled to said length responsive means for altering the predetermined length of said sequence.

21. A microprocessor controlled electronic board game comprising:

a base;

a plurality of manually operable push buttons mounted on said base;

means for generating a random time sequence of events at a predetermined time rate;

means for generating a plurality of distinct sensorially perceptible occurrences, each associated with one event of said random time sequence of events and with one of said push buttons, each of said distinct occurrences being activated in response to the associated event and in response to the actuation of said associated push button;

control means coupled to said random time sequence generating means for rendering said random sequence generating means operative to generate a first sequence of events and subsequently for rendering said occurrence generating means responsive to the actuation of said push buttons;

means responsive to said push buttons and said random sequence generating means for comparing said random time sequence of events with a manually entered time sequence of individual operations of said push buttons, said comparing means being operative to generate an error signal when said manually entered time sequence is not identical to said random time sequence of events, and for rendering said control means operative to increase the length of said random time sequence when said entered sequence corresponds to said random time sequence, wherein said control means includes means for adding an additional event to the end of said random time sequence when said entered time sequence corresponds to said random time sequence and means for generating a win signal when said manually entered time sequence is identical to said random time sequence and exceeds a first predetermined length; and means responsive to the length of said time sequence of events for increasing said predetermined time rate when the length of said sequence exceeds a second predetermined length shorter than said first predetermined length.

22. A sequencing game comprising:

means for generating a sensorially perceptible time sequence of events, said sequence generating means including means for generating a plurality of distinct sensorially perceptible events in a predetermined sequence and at a predetermined time rate;

means actuable by a participant for responding to said time sequence of events, said participant actuable means including a plurality of manually operable controls, each associated with a single one of said distinct sensorially perceptible events and actuable by the participant in response to one of said distinct events;

means coupled to said time sequence generating means and to said participant actuable means for determining the correctness of the participant's response, said correctness determining means including means for storing a representation of the time sequence generated by said time sequence generating means and means for comparing the stored representation of the time sequences generated by said time sequence generating means with the time sequence of actuation of said manually operable controls, said comparing means including means for providing a first indication when said manually operable controls are actuated in a predetermined sequence corresponding to the sequence generated by said time sequence generating means and for generating a second indication when said manually operable controls are actuated in a time sequence other than said predetermined time sequence;

means responsive to said second indication for generating an error signal and to said first indication for increasing the length of the time sequence generated by said time sequence generating means and for rendering said time sequence generating means operative to generate said increased length time sequence; and means responsive to the length of said time sequence for increasing said predetermined rate when the length of said sequence exceeds a predetermined length.

23. A microprocessor controlled game comprising:

a portable housing;

a microprocessor within said portable housing;

four push buttons disposed in a rectangular pattern within said portable housing and extending through a top surface of said housing;

four light sources disposed within said portable housing, each of said light sources being associated with a single one of said push buttons and being illuminated upon the actuation of said associated push button;

means coupled to said light sources for selectively energizing said light sources;

means within said microprocessor for generating six distinct tone frequencies, four of said distinct tone frequencies being individually associated with said four push buttons and individually generated upon the actuation of said associated push buttons, one of said tone frequencies being designated a win tone and one of said tone frequencies being designated an error tone;

transducer means coupled to said tone frequency generating means for generating a distinct audible tone in response to each of said tone frequencies;

means within said microprocessor for generating a random time sequence of events at a predetermined rate, each of said events being selected from one of four possible events, each of said possible events being associated with a single one of said push buttons and its associated light sources and tone frequency, said selective energizing means and said tone frequency generating means having a first condition of operation wherein said tone frequency generating means and said selective energizing means are responsive to said random time sequence generating means for selectively energizing one of said light sources and simultaneously generating said associated tone frequency in response to one of said associated events, said selective energizing means also having a second condition of operation wherein said tone frequency generating means and said selective energizing means are responsive to the actuation of said push buttons for selectively energizing one of said light sources and simultaneously generating said associated tone frequency in response to the actuation of said associated push button;

control means within said microprocessor for alternately operating said tone frequency generating means and said selective energizing means from said first condition of operation to said second condition of operation;

comparator means responsive to the last generated sequence of events and to the last entered sequence of actuation of said push buttons for comparing the last generated sequence of events and said last entered sequence of actuation of said associated push buttons, said comparator means being operative to render said sequence generating means operative to lengthen said sequence of events if said last generated sequence of events and said last entered sequence of actuation of said associated push buttons are identical, and for rendering said tone generating means operative to generate said error tone when said last generated sequence of events and said last sequence of actuation of said push buttons are not identical; and means responsive to the length of said last generated sequence of events for increasing said predetermined rate of generation of said random time sequence of events when said last generated random time sequence of events exceeds a predetermined length.

24. A microprocessor controlled game as recited in claim 23 wherein said length responsive means includes means coupled to said tone frequency generating means for generating said win signal when said sequence of events exceeds a second predetermined length.

25. A microprocessor controlled game as recited in claim 23 further including timing means coupled to said tone frequency generating means for rendering said tone frequency generating means operative to generate said error signal when the elapsed time between the actuation of said push buttons exceeds a predetermined time interval.

26. A microprocessor controlled game as recited in claim 23 further including means responsive to the length of time each push button is depressed and means for comparing said length of time of depression with the duration of said associated event.

27. A microprocessor controlled game as recited in claim 23 wherein said light sources are disposed below said associated push buttons and illuminate said associated push buttons upon actuation of said associated push buttons.

28. A microprocessor controlled game comprising:

a portable housing;

a microprocessor contained within said portable housing;

four push buttons disposed in a rectangular pattern within said portable housing and extending through a top surface of said housing;

four light sources disposed within said portable housing, each of said light sources being associated with a single one of said push buttons and being illuminated upon the actuation of said associated push button;

means coupled to said light sources for selectively energizing said light sources;

means within said microprocessor for generating six distinct tone frequencies, four of said distinct tone frequencies being individually associated with said four push buttons and individually generated upon the actuation of said associated push buttons, one of said tone frequencies being designated a win tone and one of said tone frequencies being designated an error tone;

transducer means coupled to said tone frequency generating means for generating a distinct audible tone in response to each of said tone frequencies;

means within said microprocessor for serially generating a random time sequence of events at a predetermined time rate, each of said events being selected from one of four possible events, each of said possible events being associated with a single one of said push buttons and its associated light sources and tone frequency, said selective energizing means and said tone frequency generating means having a first condition of operation wherein said tone frequency generating means and said selective energizing means are responsive to said random time sequence generating means for selectively energizing one of said light sources and simultaneously generating said associated tone frequency in response to one of said associated events, said selective energizing means also having a second condition of operation wherein said tone frequency generating means and said selective energizing means are responsive to the actuation of said push buttons for selectively energizing one of said light sources and simultaneously generating said associated tone frequency in response to the actuation of said associated push button;

control means within said microprocessor for alternately operating said tone frequency generating means and said selective energizing means from said first condition of operation to said second condition of operation;

comparator means within said microprocessor for comparing the last generated sequence of events with said last entered sequence of actuation of said push buttons and for increasing the length of said sequence of events when said last sequence of actuation of said push buttons is identical to said last generated sequence of events; and when said sequence of events and said sequence of actuation are not identical, rendering said tone frequency generating means operative to generate said error signal and rendering said random sequence generating means operative to eliminate the one of said possible events that corresponds to the push button actuation was not identical to the corresponding event from the sequence of events and to cause an additional event selected from one of the other ones of said possible events to be added to said sequence of events; and means responsive to the number of events for rendering said tone generating means operative to generate said win tone when all but one of the possible events have been eliminated from the sequence.

29. A microprocessor controlled game as recited in claim 28 further including means responsive to the number of possible events remaining in said sequence for rendering said tone generating means operative to generate a win tone and to illuminate the light source associated with the last remaining possible event in the sequence of events when the number of possible events in said sequence is reduced to one.

30. A microprocessor controlled game as recited in claim 28 further including timing means coupled to said tone frequency generating means for generating a predetermined time interval, said timing means including means for rendering said tone frequency generating means operative to generate said error signal when the elapsed time between the actuation of said push buttons exceeds said predetermined time interval.

31. A microprocessor controlled game as recited in claim 28 further including means responsive to the length of time each push button is depressed and means for comparing said length of time of depression with the duration of said associated event.

32. A microprocessor controlled game as recited in claim 28 further including means responsive to the length of said time sequence for increasing said predetermined time rate when the length of said sequence exceeds a predetermined length.

33. A microprocessor controlled game as recited in claim 28 wherein said light sources are disposed below said associated push buttons and illuminate said associated push buttons upon actuation of said associated push buttons.

34. A microprocessor controlled game comprising:

a portable housing;

a microprocessor contained within said portable housing;

four push buttons disposed in a rectangular pattern within said portable housing and extending through a top surface of said housing;

four light sources disposed within said portable housing, each of said light sources being associated with a single one of said push buttons and being illuminated upon the actuation of said associated push button;

means coupled to said light sources for selectively energizing said light sources;

means within said micrprocessor for generating six distinct tone frequencies, four of said distinct tone frequencies being individually associated with said four push buttons and individually generated upon the actuation of said associated push buttons, one of said tone frequencies being designated a win tone and one of said tone frequencies being designated an error tone;

transducer means coupled to said tone frequency generating means for generating a distinct audible tone in response to each of said tone frequencies;

memory means for storing representations of a first time sequence of actuation of said push buttons having a predetermined length; and comparator means for comparing said first stored sequence with a second, subsequently entered, longer time sequence of actuation of said push buttons subsequently entered by a second player, said comparator means being operative to enter said second sequence into said memory and remove said first sequence if the first portion of said second sequence is identical to said entire first sequence, said comparator being operative to end play if the first portion of said second sequence is not identical to said entire first sequence.

35. A microprocessor controlled game as recited in claim 34 wherein said comparator means includes means for rendering said tone frequency generating means operative to generate said error tone if the first portion of said second sequence is not identical to said entire first sequence.

36. A microprocessor controlled game as recited in claim 34 further including timing means coupled to said tone frequency generating means for rendering said tone frequency generating means operative to generate said error signal when the elapsed time between the actuation of said push buttons exceeds a predetermined time interval.

37. A microprocessor controlled game as recited in claim 34 further including means coupled to said representation storing means for providing a repetition of the last generated sequence that was followed by a correct participant response.

38. A microprocessor controlled game as recited in claim 34 further including means coupled to said representation storing means for providing a repetition of the longest generated sequence that was followed by a correct participant response.

39. A microprocessor controlled game as recited in claim 34 wherein said light sources are disposed below said associated push buttons and illuminate said associated push buttons upon actuation of said associated push buttons.

* * * * *